US010807770B1

(12) United States Patent
McCarthy

(10) Patent No.: US 10,807,770 B1
(45) Date of Patent: Oct. 20, 2020

(54) MATERIAL DISPENSING PACKAGING

(71) Applicant: Matthew D McCarthy, Parma Heights, OH (US)

(72) Inventor: Matthew D McCarthy, Parma Heights, OH (US)

(73) Assignee: 2 GROUP LLC, Parma, OH (US)

( * ) Notice: Subject to any disclaimer, the term of this patent is extended or adjusted under 35 U.S.C. 154(b) by 0 days.

(21) Appl. No.: 16/413,638

(22) Filed: May 16, 2019

Related U.S. Application Data

(63) Continuation-in-part of application No. 15/696,378, filed on Sep. 6, 2017, now Pat. No. 10,294,617.

(60) Provisional application No. 62/409,396, filed on Oct. 18, 2016, provisional application No. 62/383,656, filed on Sep. 6, 2016.

(51) Int. Cl.

| | |
|---|---|
| ***B65D 33/16*** | (2006.01) |
| ***B65D 5/46*** | (2006.01) |
| ***B65D 83/00*** | (2006.01) |
| ***B65D 5/72*** | (2006.01) |

(52) U.S. Cl.
CPC ..... *B65D 33/1616* (2013.01); *B65D 5/46* (2013.01); *B65D 5/725* (2013.01); *B65D 83/0055* (2013.01); *B65D 2517/0008* (2013.01); *B65D 2517/0026* (2013.01)

(58) Field of Classification Search
CPC ..... E01C 19/12; E01C 23/14; B65D 5/445; B65D 5/563
See application file for complete search history.

(56) References Cited

U.S. PATENT DOCUMENTS 2,954,901 A * 10/1960 Winstead ..... B65D 5/70 222/183
2,988,207 A * 6/1961 Lovelace ..... B65D 81/3272 206/568
3,081,003 A * 3/1963 Baxter ..... B65D 77/062 222/105
3,112,047 A * 11/1963 Weinreich ..... B65D 77/065 222/105
3,184,117 A * 5/1965 Sanderson ..... B65D 5/703 222/183
3,366,233 A * 1/1968 Roediger ..... B65D 31/02 206/524.2
3,756,471 A * 9/1973 Wissman ..... B65D 5/4204 222/156
3,819,107 A * 6/1974 Ryder, Jr. ..... B65D 63/1027 206/219
4,174,051 A * 11/1979 Edwards ..... B65D 77/065 220/288

(Continued)

*Primary Examiner* — Abigail A Risic
(74) *Attorney, Agent, or Firm* — Gugliotta & Gugliotta LPA

(57) ABSTRACT

The asphalt sealer packaging and dispensing system includes a pre-portioned, modular containment for a volume of cold pour asphalt sealer. The modular containment forms a cube shaped outer corrugated cardboard housing having a high temperature stable bladder insert. The bladder insert forms an upper handle that may extend through a first slot for handling and control of the outer housing. A dispensing tab may be formed as a tongue extension that extends through an opposing second slot. Shearing the outer terminus of the tongue extension thereby forms a shaped spout for allowing a linear output of asphalt sealer to be directly dispensed into a target surface.

19 Claims, 4 Drawing Sheets

(56) References Cited

U.S. PATENT DOCUMENTS 4,373,960 A * 2/1983 Ward, Jr. ..... C08L 95/00 106/241
4,673,125 A * 6/1987 Weaver ..... B65D 5/724 222/105
4,815,631 A * 3/1989 Eeg ..... B65D 5/4608 222/183
5,042,682 A * 8/1991 Ritter ..... B65D 77/062 222/185.1
6,962,455 B2 * 11/2005 Kugler ..... E04D 15/06 222/626
6,966,723 B2 * 11/2005 Zentner ..... E01C 11/005 404/17
7,377,420 B2 * 5/2008 Gardner ..... B65D 5/327 229/117.3
7,708,186 B2 * 5/2010 Pawlick ..... B65D 77/062 220/495.05
7,837,089 B2 * 11/2010 Pacheco ..... B65D 5/5045 229/122.23
2004/0033383 A1 * 2/2004 Zentner ..... E01C 11/005 428/543
2004/0112906 A1 * 6/2004 von Holdt, Jr. .... B65D 21/0233 220/657
2009/0101699 A1 * 4/2009 Goudreau ..... B65D 77/065 229/117.27
2013/0075298 A1 * 3/2013 Chehovits ..... B65B 29/00 206/524.7
2014/0124567 A1 * 5/2014 Ulibarri ..... B65D 75/563 229/117.09
2014/0374447 A1 * 12/2014 Coogan ..... B65D 77/0426 222/183
2015/0082748 A1 * 3/2015 Draper ..... B65D 5/061 53/401
2017/0225857 A1 * 8/2017 Splinter ..... B65B 3/04
2018/0118941 A1 * 5/2018 Stevens, III ..... B65D 81/3453
2019/0135516 A1 * 5/2019 Mabrey ..... B65D 77/064

* cited by examiner

MATERIAL DISPENSING PACKAGING

RELATED APPLICATIONS

The present invention is a Continuation in Part of U.S. Ser. No. 15/696,378 filed on Sep. 6, 2017, which claimed the benefit of U.S. Provisional Application 62/383,656 filed on Sep. 6, 2016 and U.S. Provisional Application 62/409,396 filed on Oct. 18, 2016. All of the above are incorporated by reference as if fully rewritten herein.

BACKGROUND OF THE INVENTION

1. Field of the Invention

The present invention relates to driveway sealer and repair materials and, more particularly, to an improved packaging and handling method for use therewith.

2. Description of the Related Art

Hardware stores, DIY/home improvement stores or those retailers that sell construction materials generally have a product category referred to as "driveway sealers and repair", "concrete, cement and masonry", or "concrete sealers and repair", or similar. This category includes a variety of materials for sealing or repairing concrete or asphalt surfaces. Such materials are generally asphalt based, cement base or acrylic or polymeric-based building materials.

While the properties, features or benefits of these variety of materials may vary, the distribution, sale and use of these products generally encounter some universal problems. They are heavy. They are difficult to handle and dispense by the end user. They are difficult to easily stock and display by the retailer. Their distribution range is limited due to weight, packaging and freight limitations. And, due to the chemical and/or physical properties the choice of any packaging materials may be functionally limited.

By way of example, and not meant as a limitation, one typical acrylic based driveway sealer product, designed as an asphalt driveway sealer, is distributed, displayed, sold in and dispensed from a 4 or 5 gallon plastic bucket. As asphalt ages it oxidizes and dries, leading to cracks that can facilitate water intrusion. Water intrusion, plus freezing and thawing cycles, inevitably lead to damage that can result in catastrophic failure of the asphalt. Rather than replacement of a driveway on regular intervals, a typical driveway sealer is intended to be applied over top of the asphalt in order to seal and prevent water intrusion to begin with.

Such products are typically heavy liquids that need to be rolled (with a paint roller) or squeegeed (with a dedicated squeegee device) onto a target surface, where it dries forming a protective barrier. Further, since a 5 gallon amount only covers between 600 sq. ft to 800 sq. ft of surface, and driveways can be significantly larger than that, a consumer must purchase multiple 5 gallon buckets to complete a single application. For example, one retailer, Home Depot®, regularly offers as a purchasing unit a pallet of 36 buckets/pails of such material.

This example is meant to typify common problems associate with many, if not all products related to this category. These products vary widely in formulation depending upon the manufacturer and depending upon the particular end use application for which they are intended. However, to date the best options achieved commercially for packaging that can be used conveniently from filling through distribution to end use has been a 5 gallon plastic bucket.

The use of 5 gallon plastic buckets for use with asphalt or concrete-based building repair materials leave many areas of improvement. Such buckets are expensive. Such buckets are difficult from which to dispense the product. Such buckets create weight and stacking packing density limitations when distributed or handled in volume.

It is preferable that packaging for driveway sealers and repair materials be less expensive and lighter weight that conventional plastic buckets. It also preferable that such packaging be easy to handle during transport and while dispensing. It is further preferably that such packaging allow for maximum packing density during shipping and storage. And, it is further preferable that when the use of such packaging is concluded that it provides for a reduced amount of landfillable waste, as compared with conventional plastic buckets.

Consequently, a need has been felt for providing an improved packaging and handling method for use with driveway sealers and repair materials and the like.

SUMMARY OF THE INVENTION

It is thus an object of the present invention to provide an improved packaging and handling method to replace the use of conventional 5 gallon buckets.

Briefly described according to a preferred embodiment of the present invention, a packaging system is provided comprising essentially: a polyhedral shaped outer housing; and, a containment bladder insert. The outer housing may be formed of corrugated cardboard. The containment bladder may comprise a high temperature stable gusseted bag designed of a blowmolded thermoplastic polymer that is stable to chemical and temperature conditions of the contents. The insert may include a storage volume and include at least two protuberances: an upper handle member; and a lower tongue projection. The handle member and tongue projection may be on opposing sides of the storage volume, with the handle member intended to be positioned at an upper seam or edge and the tongue projection intended to be positioned as a lower seam or edge. A filling spout may be provided for access to the storage volume, or the tongue projection may alternately function as a filling conduit that may be sealed via a connector, adhesive or weld. The containment bladder may be shaped or formed to be stored fittingly within the polyhedral shaped outer housing. The outer housing further forms a first slot for egress of the handle member and a second slot for egress of the tongue projection.

It is an advantage of the present invention to provide a packaging system that is smaller than an otherwise conventional plastic bucket.

It is another advantage of the present invention to provide a packaging system that is easier to handle, use and manipulate than an otherwise conventional plastic bucket.

It is yet anther advantage of the present invention to provide a tongue protrusion that may be extended and opened to form a dispensing spout to allow for easier application of the product contents.

It is a further advantage of the present invention to allow for a laterally elongated shaped spout to allow for patterned dispensing.

It is a further advantage of the present invention to provide a packaging system that can stand up to petroleum based products over an extended shelf life.

It is a further advantage of the present invention to provide a packaging system that can stand up to products that require filling at elevated temperatures.

It is yet a further advantage of the present invention to provide packaging that can stack and ship in a more efficient manner.

It is still a further advantage of the present invention to provide a packaging system that results in a reduced amount of packaging material that can also be recycled or partially recycled.

Further features of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
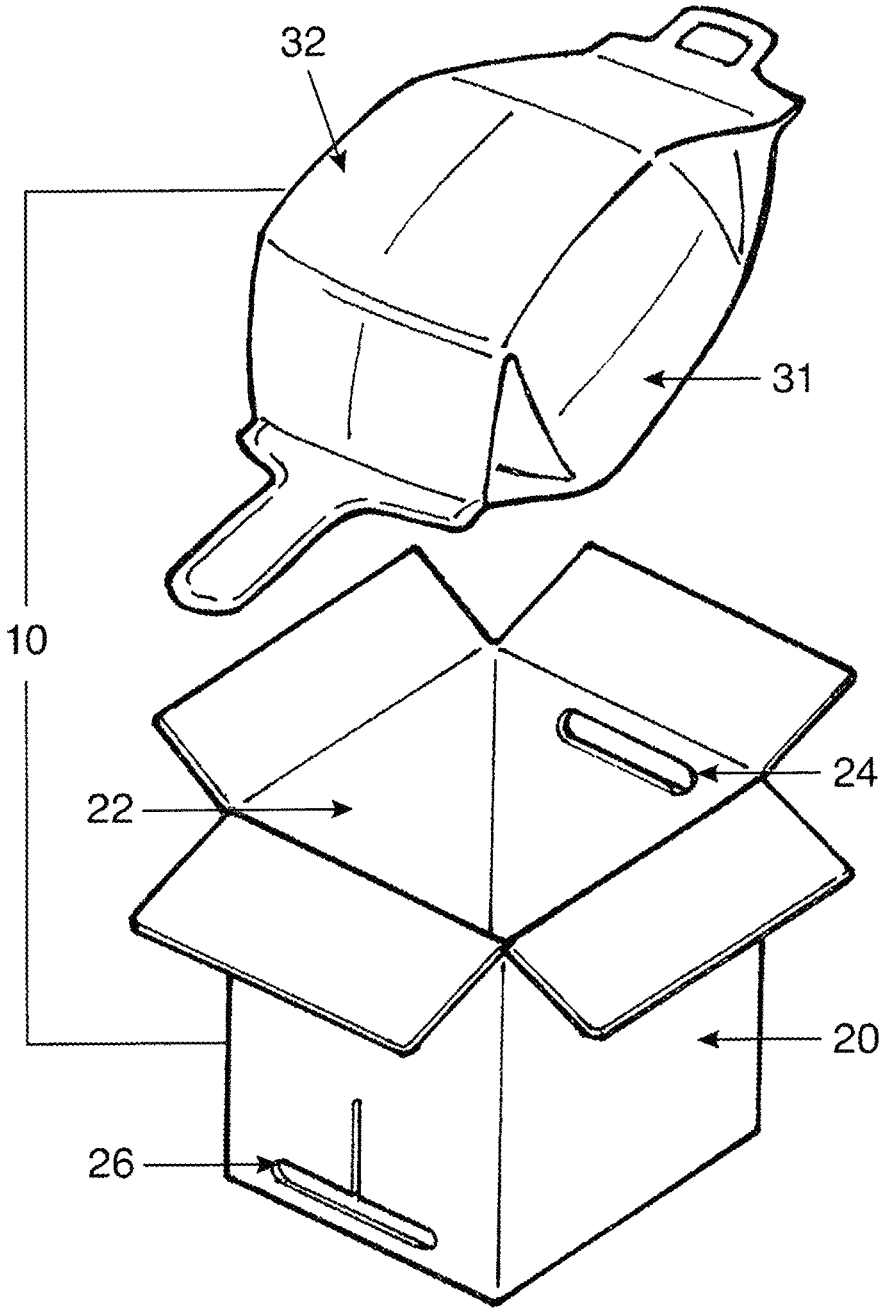
FIG. 1 is an exploded perspective view of a dispensing packaging system according to a preferred embodiment of the present invention.
Figure 2:
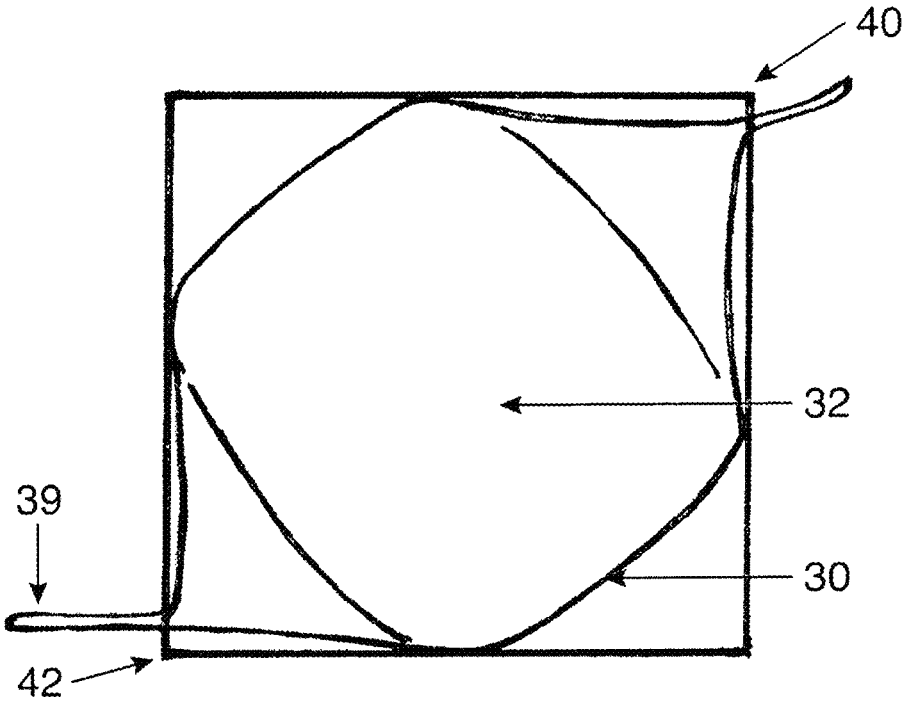
FIG. 2 is a cross sectional view of the dispensing packaging system along a lateral centerline.
Figure 3:
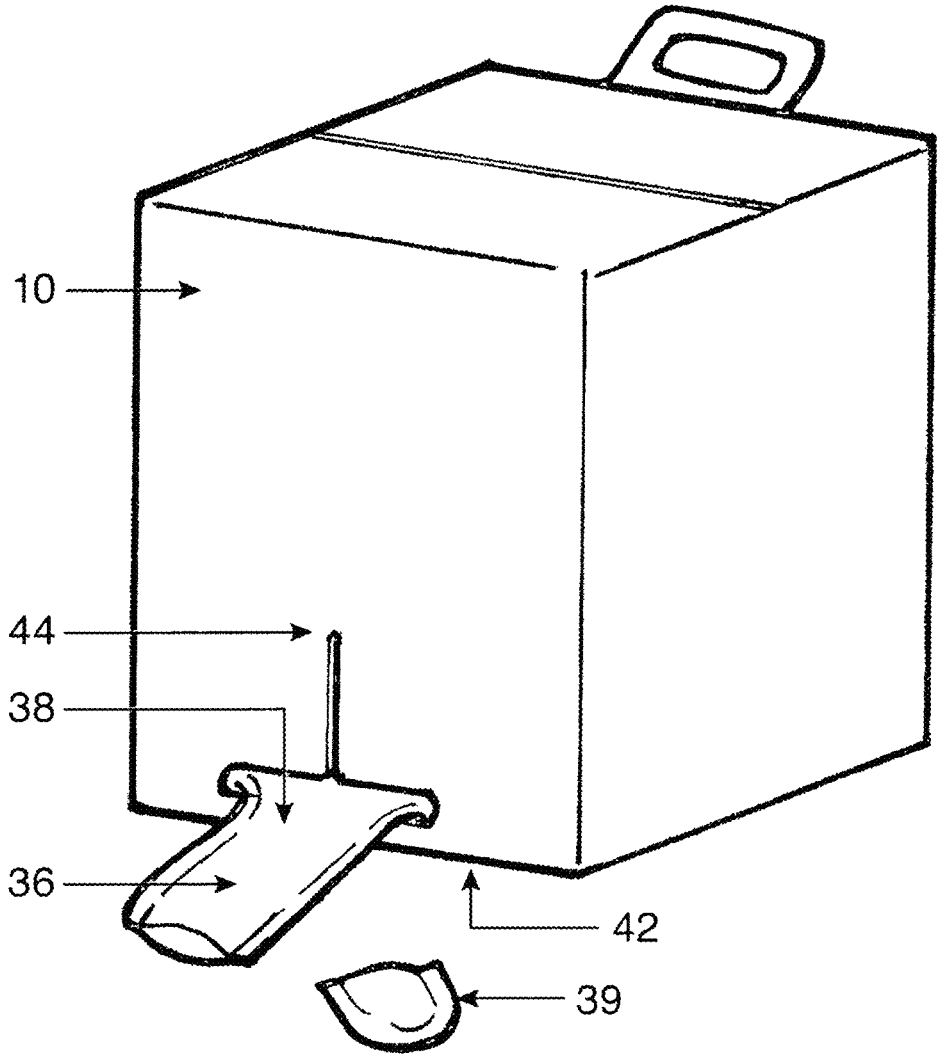
FIG. 3 is a perspective view thereof shown assembled.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Referring now to the drawings, wherein like reference numerals indicate the same parts throughout the several views, a packaging system, generally noted as 10, is provided according to the preferred embodiment of the present invention. The packaging system 10 comprising essentially: a polyhedral shaped outer housing 20; and, a containment bladder insert 30.

The outer housing 20 may be formed of corrugated cardboard. However, in light of the present teachings it should now become apparent to one having ordinary skill in the relevant art that any functionally similar material may be used so long as a sufficiently rigid, transportable, inexpensive and recyclable outer structure may be formed. The outer housing 20 may further provide an accessible interior volume 22. One side of the outer housing 20 may form a first slot 24, described in greater detail below. One side of the outer housing 20 may also form a second slot 26, described in greater detail below.

The containment bladder insert 30 may comprise a high temperature stable gusseted bag designed of a blow molded thermoplastic polymer that is stable to chemical and temperature conditions of the contents. The insert 30 may include a membrane sidewall 31 that forms a material storage volume 32. The membrane sidewall 31 may include at least two protuberances: an upper handle member 34; and a lower tongue projection 36. The handle member 34 and tongue projection 36 may be on opposing sides of the storage volume 32, with the handle member 34 intended to be positioned at an upper seam or edge 40 and the tongue projection 36 intended to be positioned as a lower seam or edge 42. An optional filling spout (not shown) may be provided for access to the storage volume 32. However, in the preferred embodiment the tongue projection 36 may alternately function as a filling conduit 38 that may be sealed via connector, adhesive or weld 39.

The containment bladder 30 may be shaped or formed to be stored fittingly within the polyhedral shaped outer housing 20. The bladder 30 may be angularly oriented within the housing volume 22. The first slot 24 may be positioned for egress of the handle member 34, and may be adapted to allow carrying or handling of the entire packaging structure 10. The second slot 26 may be positioned for egress of the tongue projection 38.

It is an intended aspect of the present invention that the insert 30 be collapsible in a structured, targeted manner such as to allow for the component to be nested within the outer housing 20. It is a further intended aspect of the present invention that the outer housing 20 be adapted so that a plurality of such packages 10 may be regularly stacked. Such nesting creates efficiency in shipping from a blow molder to a packing/filling facility. Further, such collapsible nature of the insert 44 can aid in breaking down the packaging elements upon completion by the user and in preparation for recycling or disposal.

As shown, described and taught in the present disclosure, the improved packaging fulfills long felt and yet unfilled needs in the handling, shipping, transport, and dispensing of certain building and maintenance materials. These include driveway sealers and repair materials and the like. However, one skilled in a relative art, in light of the present invention, may see further use extensions with other materials, such a paint, coatings, or as yet unidentified materials that are sold in a bulk, liquid, heavy manners that require dispensing for application or use.

2. Operation of the Preferred Embodiment

The intended operation of the present invention is to replace the use of otherwise conventional 4 or 5 gallon plastic buckets for the transport, manipulation and dispensing of a contained product. To this end, the contained product may be placed within a high temperate stable polymeric gusseted bag containment insert 30, and then inserted into an assembled corrugated cardboard outer housing 20. The box/bag combination is then stored fittingly within the polyhedral shaped (shown herein as a cube shaped) corrugated cardboard outer housing 20.

The containment bladder 30 may then be filled with liquid contents and sealed. Given that asphalt-based materials are thermoplastic (i.e., softens as it warms, and stiffens as it cools), these are processed at elevated temperatures and will be filled within the packaging system 10 at temperatures up to or exceeding 150° F. As such, the bladder membrane 31 must be made of high temperature stable materials that can withstand contact with such materials and at such temperatures.

Figure 4:
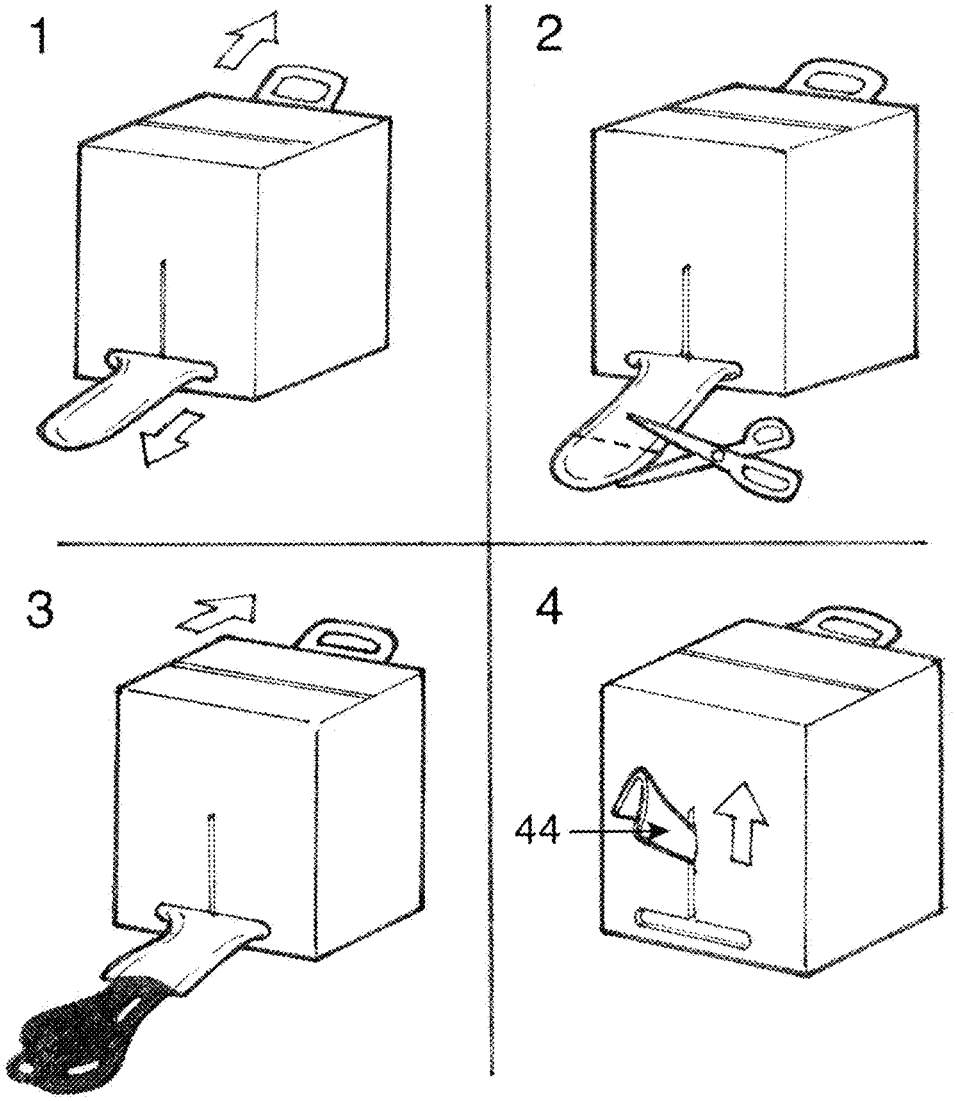
FIG. 4 is a schematic illustration showing a method of dispensing material using the packaging system of FIG. 1 through FIG. 3.

It is intended that various other aspects of the present invention may include other features to allow for easy dispensing of product for use from the packaging system 10. Referring now in conjunction with FIG. 4, by way of one exemplary use and not meant as a limitation, when a consumer is currently dispensing driveway sealer from a 5 gallon plastic bucket they are required to spill a small amount of material at a time by tipping the bucket, and then rolling or squeegeeing the material about a partial coverage area. This process is repeated. However, this process is far from precise, and can cause mess or undesired overpour, especially at the beginning when the 5 gallon bucket is full and has an initial weight of 40, 50 or more pounds. In such use, the present invention not only includes a dispensing spout 38 that can be used to control liquid dispensing, but may include other features to allow additional control of an amount of dispensing pattern of material. These may include valving mechanisms or various geometry spout cross sections (e.g., oval, square, etc.) to allow for a more accurate controlled dispensing of either volume, or pattern, or both.

Once filed, the cubic cardboard outer housing functions as a very efficient packaging system, providing maximum packing density for shipping and transport, as well as ease of handling by the end consumer.

In operation, a consumer would merely transport the packaging system to a jobsite (with hand truck or manually carrying via the handle holds of the sidewalls), and placed near a desired dispensing area. The user then may then extend the tongue protrusion 38 (step 1), and cut the outer terminus of the tongue dispenser (step 2). The user may then apply amounts of a product in a targeted manner for use, with dispensing being in a more controlled manner than is otherwise obtainable with conventional plastic buckets (step 3).

The second sot 26 may further include a vertical seam 44. This may allow a user to impinge the remaining tongue material to seal the formed dispensing spout and stop the flow of material.

The foregoing descriptions of specific embodiments of the present invention are presented for purposes of illustration and description. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as is suited to the particular use contemplated. It is intended that a scope of the invention be defied broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar caselaw or subsequent precedent should not be made if any future claims are added or amended subsequent to this Patent Application.

What is claimed is:

1. A bucketless dispensing packaging system consisting essentially of:

an outer housing having a polyhedral shape having at least six side panels circumscribing an accessible interior volume, said polyhedral shape forming at least a first slot on a first side panel and a second slot on a second side panel opposite the first side panel in an arrangement to be angularly opposed with the first slot, the first slot being positioned at an upper edge of the first side panel and the second slot being positioned at a lower edge of the second side panel opposed to said upper edge;

a containment bladder insert fitting within said interior volume and forming a membrane sidewall that forms a material storage volume, the membrane sidewall including at least one upper handle member and a lower tongue projection;

the at least one upper handle member projecting through the at least one first slot positioned at an upper portion of the first side panel;

the lower tongue projection extending through the second slot positioned at a lower portion of the second side panel;

said tongue projection forming a conduit in a gravity urged fluid communication with said material storage volume from the upper handle; and a conduit closure comprising a connector, adhesive or weld, said conduit closure adapted for forming at least a controlled fluid discharge.

2. The bucketless dispensing packaging system of claim 1, wherein said housing is formed of corrugated cardboard.

3. The bucketless dispensing packaging system of claim 1, wherein said containment bladder further comprises a high temperature stable gusseted bag of a thermoplastic polymer that is stable to chemical and temperature conditions of contents within said material storage volume.

4. The bucketless dispensing packaging system of claim 3, wherein said contents comprise a cold pour asphalt sealer.

5. The bucketless dispensing packaging system of claim 2, wherein said containment bladder further comprises a high temperature stable gusseted bag of a thermoplastic polymer that is stable to chemical and temperature conditions of contents within said material storage volume.

6. The bucketless dispensing packaging system of claim 5, wherein said contents comprise a cold pour asphalt sealer.

7. The bucketless dispensing packaging system of claim 1, wherein said containment bladder is angularly oriented within the housing volume such that at least one handle is be positioned above and opposed to said lower tongue projection.

8. The bucketless dispensing packaging system of claim 2, wherein said containment bladder is angularly oriented within the housing volume such that at least one handle is be positioned above and opposed to said lower tongue projection.

9. The bucketless dispensing packaging system of claim 3, wherein said containment bladder is angularly oriented within the housing volume such that at least one handle is be positioned above and opposed to said lower tongue projection.

10. The bucketless dispensing packaging system of claim 4, wherein said containment bladder is angularly oriented within the housing volume such that at least one handle is be positioned above and opposed to said lower tongue projection.

11. The bucketless dispensing packaging system of claim 5, wherein said containment bladder is angularly oriented within the housing volume such that at least one handle is be positioned above and opposed to said lower tongue projection.

12. A method for dispensing a cold pour asphalt sealer using a bucketless dispensing packaging system of claim 1, comprising the steps:

a. positioning the packaging system to a target surface using the at least one upper handle member to place directly adjacent to a desired dispensing area;
b. extending the tongue protrusion directed toward the desired dispensing area;
c. opening an outer terminus of the tongue dispenser; and
d. directing a flow of cold pour asphalt sealer through the conduit onto the desired dispensing area.

13. A method for dispensing a cold pour asphalt sealer using a bucketless dispensing packaging system of claim 2, comprising the steps:

a. positioning the packaging system to a target surface using the at least one upper handle member to place directly adjacent to a desired dispensing area;
b. extending the tongue protrusion directed toward the desired dispensing area;
c. opening an outer terminus of the tongue dispenser; and
d. directing a flow of cold pour asphalt sealer through the conduit onto the desired dispensing area.

14. A method for dispensing a cold pour asphalt sealer using a bucketless dispensing packaging system of claim 3, comprising the steps:

a. positioning the packaging system to a target surface using the at least one upper handle member to place directly adjacent to a desired dispensing area;
b. extending the tongue protrusion directed toward the desired dispensing area;
c. opening an outer terminus of the tongue dispenser; and
d. directing a flow of cold pour asphalt sealer through the conduit onto the desired dispensing area.

15. A method for dispensing a cold pour asphalt sealer using a bucketless dispensing packaging system of claim 5, comprising the steps:

a. positioning the packaging system to a target surface using the at least one upper handle member to place directly adjacent to a desired dispensing area;
b. extending the tongue protrusion directed toward the desired dispensing area;
c. opening an outer terminus of the tongue dispenser; and
d. directing a flow of cold pour asphalt sealer through the conduit onto the desired dispensing area.

16. A method for dispensing a cold pour asphalt sealer using a bucketless dispensing packaging system of claim 7, comprising the steps:

a. positioning the packaging system to a target surface using the at least one upper handle member to place directly adjacent to a desired dispensing area;
b. extending the tongue protrusion directed toward the desired dispensing area;
c. opening an outer terminus of the tongue dispenser; and
d. directing a flow of cold pour asphalt sealer through the conduit onto the desired dispensing area.

17. A method for dispensing a cold pour asphalt sealer using a bucketless dispensing packaging system of claim 8, comprising the steps:

a. positioning the packaging system to a target surface using the at least one upper handle member to place directly adjacent to a desired dispensing area;
b. extending the tongue protrusion directed toward the desired dispensing area;
c. opening an outer terminus of the tongue dispenser; and
d. directing a flow of cold pour asphalt sealer through the conduit onto the desired dispensing area.

18. A method for dispensing a cold pour asphalt sealer using a bucketless dispensing packaging system of claim 9, comprising the steps:

a. positioning the packaging system to a target surface using the at least one upper handle member to place directly adjacent to a desired dispensing area;
b. extending the tongue protrusion directed toward the desired dispensing area;
c. opening an outer terminus of the tongue dispenser; and
d. directing a flow of cold pour asphalt sealer through the conduit onto the desired dispensing area.

19. A method for dispensing a cold pour asphalt sealer using a bucketless dispensing packaging system of claim 11, comprising the steps:

a. positioning the packaging system to a target surface using the at least one upper handle member to place directly adjacent to a desired dispensing area;
b. extending the tongue protrusion directed toward the desired dispensing area;
c. opening an outer terminus of the tongue dispenser; and
d. directing a flow of cold pour asphalt sealer through the conduit onto the desired dispensing area.

* * * * *